United States Patent [19]

Caccioppo

[11] Patent Number: 4,712,570

[45] Date of Patent: Dec. 15, 1987

[54] COMBINATION BRUSH/ROLLER HAIR-GROOMING TOOL

[76] Inventor: Sebastian Caccioppo, 201 E. 28th St., New York, N.Y. 10016

[21] Appl. No.: 838,556

[22] Filed: Mar. 11, 1986

[51] Int. Cl.[4] ..... A45D 2/00

[52] U.S. Cl. ..... 132/40; 132/34 R; 132/9

[58] Field of Search ..... 132/39 R, 9, 33 R, 42 R, 132/41 R, 40, 85, 34 R, 37, 34 A; 15/159, 167, 176, 179, 202

[56] References Cited

U.S. PATENT DOCUMENTS

| | | | |
|---|---|---|---|
| 2,959,800 | 11/1960 | Bischoff | 401/16 |
| 3,225,373 | 12/1965 | Kisbany | 15/104 A |
| 3,413,984 | 12/1968 | Tracy et al. | 132/34 R |
| 3,421,170 | 1/1969 | Thomas, Jr. | 206/446 |
| 3,426,766 | 2/1969 | Castellano | 132/34 R |
| 3,566,885 | 2/1971 | Meyer | 132/39 |
| 3,623,179 | 11/1971 | Roth | 15/104 R |
| 3,967,630 | 7/1976 | Zuhlsdorff et al. | 132/40 |
| 3,974,841 | 8/1976 | Weisman | 132/40 |
| 4,167,192 | 9/1979 | Arnold | 132/33 R X |
| 4,260,871 | 4/1981 | Nagelkerke | 132/9 X |
| 4,267,851 | 5/1981 | Plaisted | 132/39 X |

*Primary Examiner*—Robert P. Swiatek
*Assistant Examiner*—J. Hakomaki
*Attorney, Agent, or Firm*—Michael J. Striker

[57] ABSTRACT

A hair-grooming tool has a tubular roller sleeve extending along a sleeve axis and having an axially open rear end and an opposite axially substantially closed front end provided with an axially backwardly open seat and an array of bristle tufts projecting radially from the sleeve. A separate wand extending along a wand axis has a rear handle portion adapted to be held in the hand and an opposite front portion terminating at a front wand end and fittable snugly within the roller sleeve with the axes coaxial. A locking formation on the closed end of the wand is shaped to fit axially forward into the seat to retain the roller sleeve on the wand against axial movement thereon in a holding position and to permit the roller sleeve to be axially separated from the wand in a freeing position. Thus the roller is fitted to the wand to form a brush that is used to brush out and then wind up the lock of hair in question. Then the wand is pulled out of the roller and a new roller is mounted on it to continue the operation.

4 Claims, 4 Drawing Figures

COMBINATION BRUSH/ROLLER HAIR-GROOMING TOOL

FIELD OF THE INVENTION

The present invention relates to a hair-grooming tool. More particularly this invention concerns a hair brush and a hair roller.

BACKGROUND OF THE INVENTION

A standard hairdressing procedure involves brushing out a lock of hair, winding it up on a roller, and securing the roller in place with a pin or clip so the lock does not unwind. Typically the beautician holds the lock with the left hand and combs it out with the right, then exchanges the brush in the right hand for the roller and winds up the lock on the roller with both hands, and finally affixes the pin with the right hand while holding the wound-up lock with the left.

Such a procedure must be repeated many times for a single hairdo. As a result brushing out and rolling up is a fairly lengthy procedure.

OBJECTS OF THE INVENTION

It is therefore an object of the present invention to provide an improved hair-grooming tool.

Another object is the provision of such a hair-grooming tool which substantially simplifies the above-described procedure for setting a person's hair with rollers.

SUMMARY OF THE INVENTION

A hair-grooming tool according to the invention has a tubular roller sleeve extending along a sleeve axis and having an axially open rear end and an opposite axially substantially closed front end provided with an axially backwardly open seat and an array of bristle tufts projecting radially from the sleeve. A separate wand extending along a wand axis has a rear handle portion adapted to be held in the hand and an opposite front portion terminating at a front wand end and fittable snugly within the roller sleeve with the axes coaxial. A locking formation on the closed end of the wand is shaped to fit axially forward into the seat to retain the roller sleeve on the wand against axial movement thereon in a holding position and to permit the roller sleeve to be axially separated from the wand in a freeing position.

Thus with the system of this invention the roller, which can be of generally standard construction except for the closed end and the seat, is fitted to the wand to form a brush that is used to brush out and then wind up the lock of hair in question. Then the wand is pulled out of the roller and a new roller is mounted on it to continue the operation. There is no need in the middle of working on a given lock of hair for the operator to put down the brush and pick up a roller, and the roller mounted on the brush is particularly easy to roll up a lock of hair on.

According to another feature of this invention the sleeve and wand are basically cylindrical. In addition the formation extends axially from the wand end and has a radial projection and the seat has a portion extending between the projection and the wand end in the locking position and axially clear of the projection in the freeing position. This seat is open toward the open end of the sleeve and is undercut. The formation is most effective when it is T-shaped, and the seat is formed as a slot that is undercut angularly on both sides so that the arms of the locking tee will hold in the seat no matter which way the roller is rotated with the wand.

DESCRIPTION OF THE DRAWING

The above and other features and advantages will become more readily apparent from the following, reference being made to the accompanying drawing in which.

SPECIFIC DESCRIPTION

Figure 1:
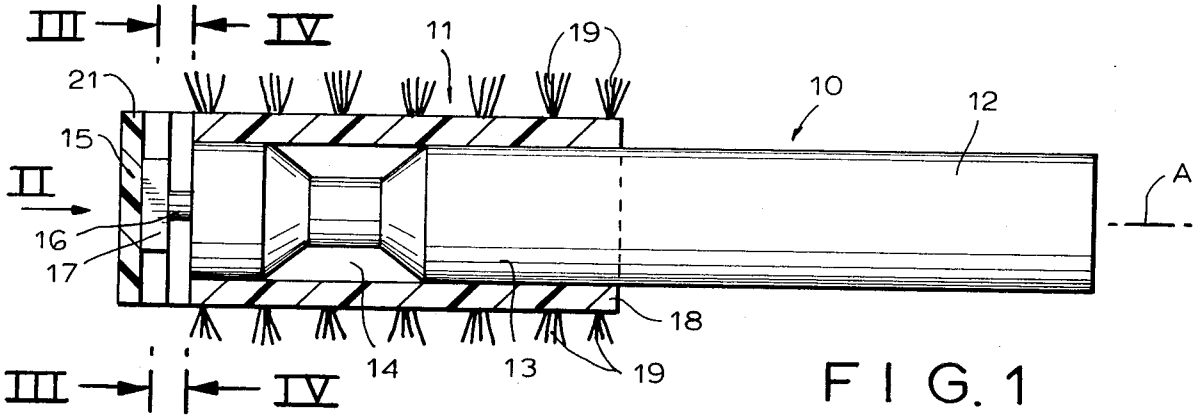
FIG. 1 is an axial section through the hair-grooming tool according to this invention.
Figure 4:
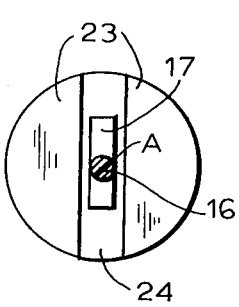
FIGS. 3 and 4 are sections taken respectively along lines III—III and IV—IV of FIG. 1.
Figure 3:
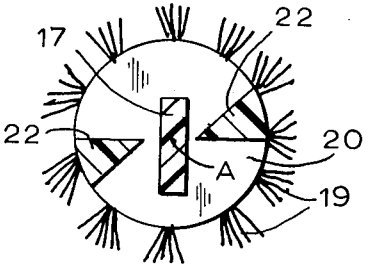
Figure 2:
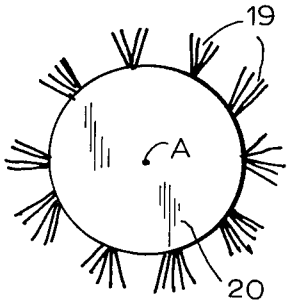
FIG. 2 is an end view taken in the direction of arrow II of FIG. 1.

As seen in the drawing, the combination brush/roller according to this invention basically comprises a wand 10 and a roller 11 both centered on and normally extending along the same axis A.

The wand 10 is normally about 5 in in length and 0.875 in in diameter and can be made of metal, a synthetic resin such as nylon TM, or even of wood. It has a cylindrical handle portion 12 comprising about one third its length and a roller-holding portion 13 formed with an annular recess 14 facilitating slipping the roller 11 on and removing it from the wand 10. At its roller end the wand 10 has a T-shaped holding formation 15 comprised of a central small-diameter stem 16 extending about 0.125 in on the axis and a traverse 17 extending diametrally thereof and having a length of about 0.5 in. This tee 15 is normally unitary with the wand 10, especially when same is of a cast synthetic resin.

The roller 11 comprises, as is standard, a synthetic-resin sleeve 18 of an inside diameter generally equal to the outside diameter of the wand 10 and provided with a multiplicity of bristle tufts 19 in an array extending angularly and axially on the sleeve 18. One end (the right-hand one as seen in FIG. 1) of the sleeve 18 is open and the opposite end is closed by a wall or disk 20 formed basically as a circularly continuous outer part 21, a pair of triangular webs 22, and a pair of identical circular segmental parts 23 supported by the webs 22 on the disk 21. The two parts 23 define a diametral gap or slot 24 of a width slightly greater than the tee 15 and are of a thickness equal to slightly less than the length of the stem or post 16 of the tee. The webs 22 have flanks that, if extended, would be similarly spaced and lie wholly outside the gap 24. The result is therefore an undercut seat structure.

In normal use the roller 11 is pushed down over the end of the wand 10 and is rotated and pushed simultaneously until the traverse 17 of the tee 15 aligns with and fits into the slot 24. Once the traverse 17 is engaged under the segments 23 the brush formed by the parts 10 and 11 is used in the standard manner. If rotated in either direction, with some angular tension exerted as is inevitable with a standard hairbrush, the roller 11 will stay locked on the wand 10. Even if the rotation direction is reversed the structure will stay together, with the traverse 17 pivoting in the undercut seat and engaging the other flanks of the webs 22, so long as the wand 10 is not simultaneously pulled axially from the roller 11. The parallel flanks of the formations 22 ensure flat contact with the sides of the traverse 17 so that good force transmission is assured.

To separate the wand 10 and roller 11, once the lock of hair has been combed out and rolled up, the operator merely grips the roller 11 in one hand while simultaneously rotating the wand 10 with the other while pulling it from the roller 11. As soon as the traverse 17 aligns with the slot 24, the wand 10 will pull out.

I claim:

1. A hair-grooming tool, comprising a wand extending along a wand axis and having a rear handle portion adapted to be held in the hand and an opposite front portion having a front wand end, said front wand end being provided with a projection extending transversely said wand axis; and a tubular roller sleeve extending along a sleeve axis and having an axially open first roller end and an opposite closed second roller end, said roller sleeve being provided with radially outwardly projecting bristle tufts, said roller sleeve having at said second roller end two walls extending transversely to said sleeve axis and spaced from one another in an axial direction so as to define a space therebetween, one of said walls being solid while the other of said walls being provided with a transverse slot, and said roller sleeve being provided in said space between said walls with two webs spaced from one another in a circumferential direction, so that said wand can be removably attached to said roller sleeve by passing said projection of said wand in an insertion direction through said slot of said other wall of said roller sleeve, and then turning said wand and thereby said projection of said wand to a position circumferentially offset from said slot so that said other wall of said roller sleeve than prevents unintentional axial withdrawal of said wand from said roller sleeve in a direction opposite to said insertion direction during operation, by abutting said projection of said wand against said other wall of said roller sleeve, while said webs of said wand prevent unintentional rotation of said wand relative to said roller sleeve during operation.

2. A hair-grooming toll as defined in claim 1, wherein said wand further has a stem extending from said front wand end and connectiong said front portion with said transverse projection of said wand.

3. A hair-grooming tool as defined in claim 1, wherein said webs of said roller sleeve are arranged substantially diametrically opposite to one another and formed so that each of said webs have a radially inwardly decreasing cross section.

4. A hair-grooming tool as defined in claim 1, wherein said projection of said wand has a predetermined width, said webs of said roller sleeve being spaced from one another by a distance which is at least equal to said width of said projection.

* * * * *